US008381737B2

(12) United States Patent
Jones

(10) Patent No.: US 8,381,737 B2
(45) Date of Patent: Feb. 26, 2013

(54) AUTO IGNITING SMOKING PIPE

(76) Inventor: Mike Jones, Kenmore, WA (US)

( * ) Notice: Subject to any disclaimer, the term of this patent is extended or adjusted under 35 U.S.C. 154(b) by 512 days.

(21) Appl. No.: 12/758,766

(22) Filed: Apr. 12, 2010

(65) Prior Publication Data

US 2010/0186758 A1 Jul. 29, 2010

Related U.S. Application Data

(63) Continuation-in-part of application No. 11/236,344, filed on Sep. 27, 2005, now Pat. No. 7,694,685.

(51) Int. Cl.
*A24F 3/00* (2006.01)

(52) U.S. Cl. ..... 131/185

(58) Field of Classification Search ..... None
See application file for complete search history.

(56) References Cited

U.S. PATENT DOCUMENTS

| | | | | |
|---|---|---|---|---|
| 2,398,695 | A | 4/1946 | Cloutier | 131/185 |
| 2,549,726 | A | 4/1951 | Van Toll | 131/185 |
| 2,549,727 | A | 4/1951 | Van Toll | 131/185 |
| 2,578,061 | A | 12/1951 | Greenblatt | 131/185 |
| 2,595,534 | A | 5/1952 | Nicholson et al. | 131/185 |
| 3,986,516 | A | 10/1976 | Brooks | 131/185 |
| 4,223,686 | A | 9/1980 | Murray, Jr. | 131/173 |
| 4,223,687 | A | 9/1980 | Sandeen | 131/180 |
| 4,276,892 | A | 7/1981 | Iaquinta | 131/185 |
| 5,417,227 | A | 5/1995 | West | 131/185 |

*Primary Examiner* — Michael J Felton
(74) *Attorney, Agent, or Firm* — Dean A. Craine

(57) ABSTRACT

A smoking pipe comprising an elongated body with a removable chassis located therein. Located on the chassis is a lighter with an activation switch and flame opening located on one end. The lighter is positioned in the chassis so that the lighter's flame opening is located adjacent to the upper bowl on the bowl assembly also mounted on the chassis. Formed over the upper bowl are air openings which allow heated hot gas to enter the bowl and vaporize or burn material placed therein Rotatably mounted on the lower neck on the bowl assembly is a ratchet. Attached to the ratchet is an elongated mouthpiece. The ratchet which includes a cam surface with a hook formed thereon that engages the distal end of a pawl. The proximal end of the pawl sits in a receiving cavity form a moveable head also mounted on the chassis that selectively presses against the activation switch on the lighter. The relative locations of the cam surface, smoke bores on the bowl assembly, and the mouthpiece are designed so that less movement of the mouthpiece is required to activate the lighter.

3 Claims, 14 Drawing Sheets

AUTO IGNITING SMOKING PIPE

This is a continuation in part application of U.S. utility patent application (Ser. No. 11/236,344), filed on Sep. 27, 2005.

BACKGROUND OF THE INVENTION

1. Field of the Invention

This invention relates to smoking pipes and more particularly, to smoking pipes used with tobacco or medicinal containing chemicals that require a constant ignition source for combustion.

2. Description of the Related Art

It is known that inhalation administration is a well known method for delivering medications to the body. With some medication, inhalation administration is preferred due to its faster onset of activity and because it bypasses the gastrointestinal and hepatic systems that can destroy or deactivate some medications.

Some chemicals, such as nicotine, are natural occurring substances found in tobacco plants that are released when the plant is burned. The released chemical is distributed in the smoke that when inhaled, is absorbed through the lungs and into the body. Unfortunately, some plants are not readily combustible and require a continuous source of ignition to maintain combustion.

SUMMARY OF THE INVENTION

It is an object of the herein described invention to provide a compact, easy-to-use pipe for smoking combustible substances, such as tobacco.

It is another object of the invention to provide such a pipe that includes a built-in lighter that when activated, produces a continuous source of ignition.

It is a further object of the invention to provide such a pipe that includes an automatic ignition feature when the pipe is used.

These and other objects of the invention are met by a smoking pipe with a built-in lighter and an automatic ignition feature that produces a continuous flame for combusting a smoking substance placed in the pipe's bowl assembly. The smoking pipe includes an elongated body with a front bowl cavity and a rear lighter cavity. Disposed inside the bowl cavity is a pipe bowl assembly. Disposed inside the lighter cavity is a compact propane lighter that includes a head with a flame port and a push-button switch. When the bowl assembly is disposed inside the bowl cavity, it is perpendicularly aligned with the lighter. During assembly, the lighter is placed inside the lighter cavity so that the flame port is placed adjacent to the upper bowl formed on the bowl assembly. The push-button switch is disposed adjacent to a plunger assembly located near the elongated body's bottom surface. The top of the bowl is open and adjacent to the top opening on the elongated body so that a desired amount of smoking substance may be easily packed therein by the user. Formed on the sides of the bowl are small openings which allow outside air and the flame from the lighter flame port, respectively, to enter the bowl and ignite the smoking substance during use.

Pivotally attached to the bottom portion of the elongated body is a mouthpiece. The mouthpiece is an elongated structure with a round wide head and a narrow arm. Extending longitudinally inside the mouthpiece and between the head and the arm is an air passageway. In the preferred embodiment, the mouthpiece nests into a elongated recessed cavity, longitudinally aligned and formed on the bottom surface of the elongated body. Formed in the head is a bore designed to receive the lower neck section on the bowl assembly when the bowl assembly is placed inside the bowl cavity. Formed on the sidewall of the lower neck is a bore that communicates with the main passageway longitudinally formed inside the bowl assembly. When the mouthpiece is perpendicularly aligned with the elongated body, and the head is placed around the neck section, the air passageway on the mouthpiece is aligned with the bore formed on the neck section. When the mouthpiece is rotated around the lower neck to a perpendicularly aligned position on the elongated body and the user places his or her mouth over the distal end of the mouthpiece and inhales, air and smoke may be drawn downward though the bowl assembly and into the air passageway in the mouthpiece.

As stated above, the pipe is used with a particular type of lighter with a push-button style activation switch. An automatic ignition means is provided that couples the pivoting movement of the mouthpiece with the activation switch on the lighter. In the preferred embodiment, the automatic ignition means is a cam surface formed on the wide neck on the mouthpiece and a plunger assembly located along the bottom surface of the elongated body. When the mouthpiece is rotated over the neck section to a perpendicularly aligned position on the elongated body, a plunger arm on the plunger assembly is forced inward which automatically ignites the activation switch on the lighter.

When the mouthpiece is disposed on the neck section and longitudinally aligned with the elongated handle, the air passageway on the mouthpiece is mis-aligned with the bore formed on the neck section thereby preventing the inhalation of smoke from the bowl assembly.

Formed on the bowl assembly is an alignment peg that engages the elongated body and radially locks the bowl assembly in position inside the bowl cavity.

Also shown herein is a second embodiment of the smoking pipe designed to reduce the amount of rotation the mouthpiece must move to activate the lighter's activation switch. In the second embodiment, an partially enclosed, hollow elongated body is provided with a front opening. Disposed inside the elongated body is a rigid chassis. Longitudinally aligned and mounted on the chassis is a gas lighter with an activation switch and flame opening located on one end. The lighter is positioned on the chassis so that the lighter's flame opening is located adjacent to the upper bowl on a vertically aligned bowl assembly mounted on one end of the chassis. The bowl assembly includes a lower neck with a smoke and ash passageway formed therein. Formed on the upper bowl are a plurality of air openings which allows heated hot gas to enter the bowl to vaporize or burn material placed in the upper bowl. Formed between the lower surface of the bowl assembly and the chassis is a key and keyset formed that rotatable locks the bowl assembly in a fixed position on the chassis. Formed on the lower portion of the neck is a smoke outlet port aligned approximately 150 degrees away from the air openings.

Mounted on the chassis is a rotating ratchet. The ratchet includes a center bore through which the neck on the bowl assembly extends. The ratchet is able to rotate freely around the bowl assembly's neck. Formed on the ratchet is a cam surface and a mouthpiece receiving bore. A smoke conduit is formed between the center bore and the smoke bore. During assembly, the mouthpiece is inserted into the smoke bore. When the ratchet is rotated so that the smoke conduit is aligned with the smoke outlet port on the neck, smoke may be drawn downward.

The ratchet's cam surface includes a hook that pressed against pawl. The proximal end of the pawl sits in a receiving cavity form a moveable head that selectively presses against the activation switch on the lighter. During assembly, the lighter, the bowl assembly, the mouthpiece, the ratchet, the pawl, and the head are all mounted on a chassis that slides into the cavity formed on the elongated body to hold the components together.

DESCRIPTION OF THE PREFERRED EMBODIMENT(S)

Figure 1:
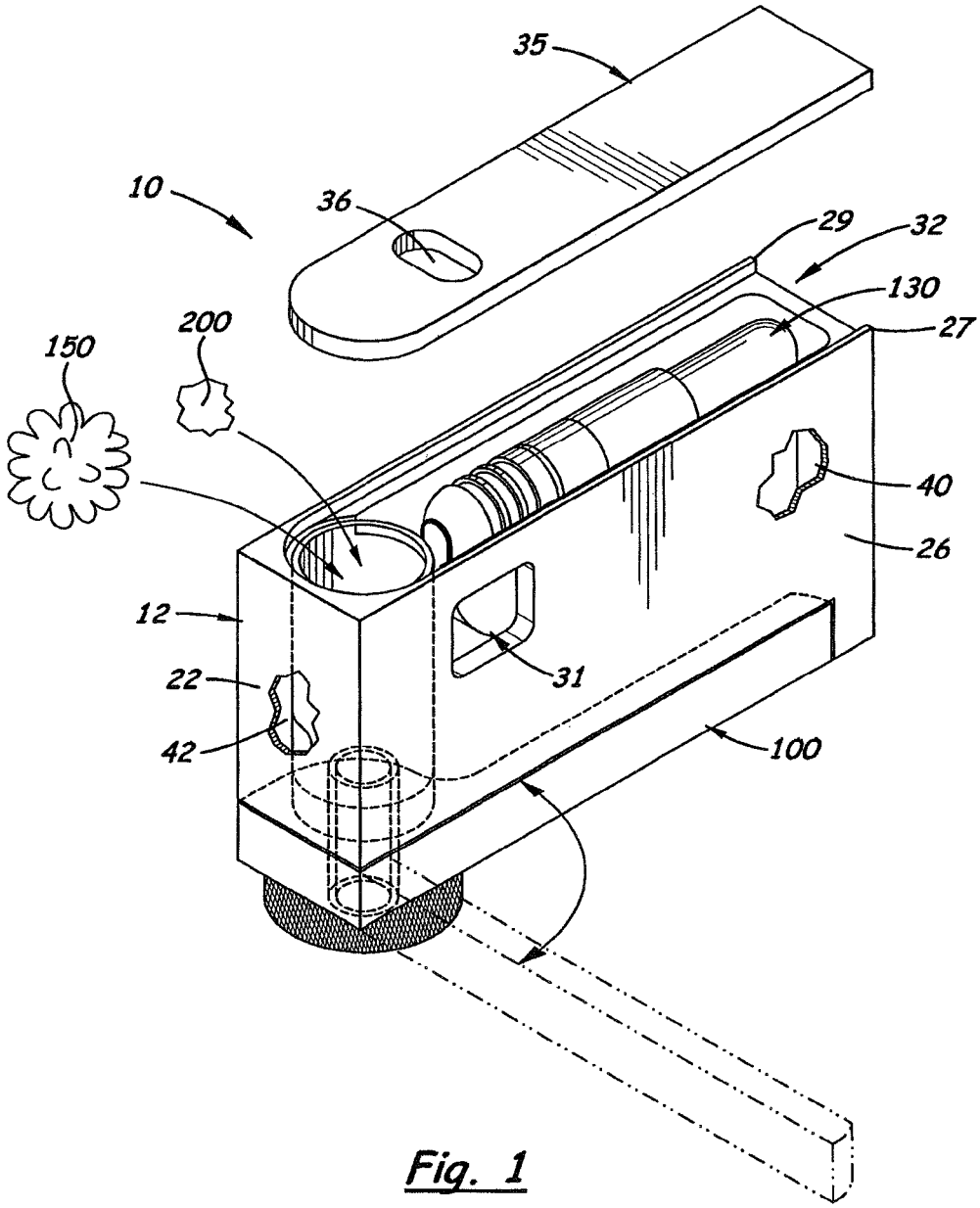
FIG. 1 is a perspective view of the auto-igniting smoking pipe disclosed herein.
Figure 2:
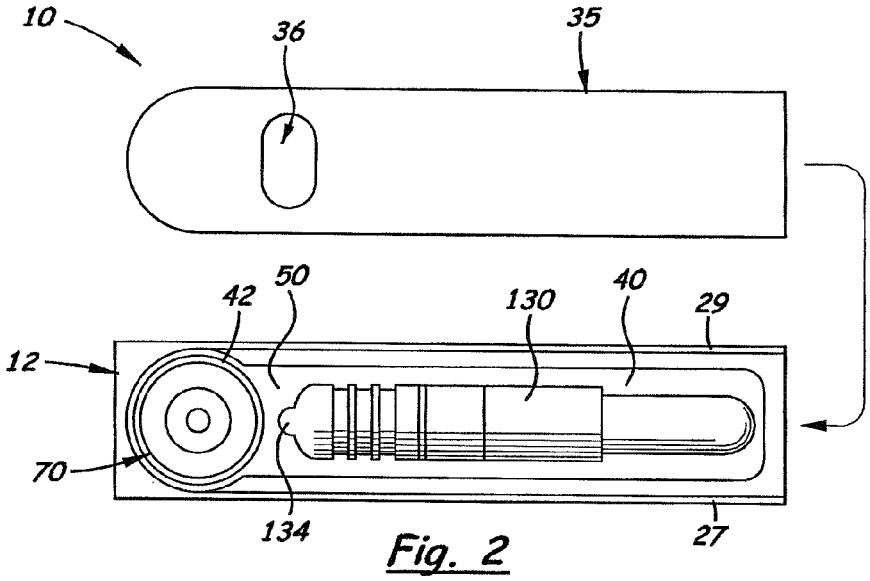
FIG. 2 is a top plan view of the smoking pipe showing the lid removed.
Figure 3:
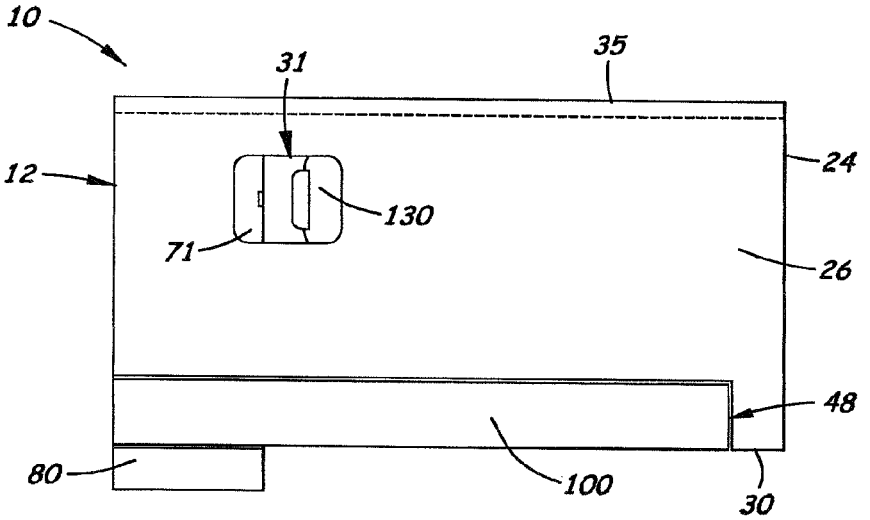
FIG. 3 is a left side elevation view of the smoking pipe.
Figure 4:
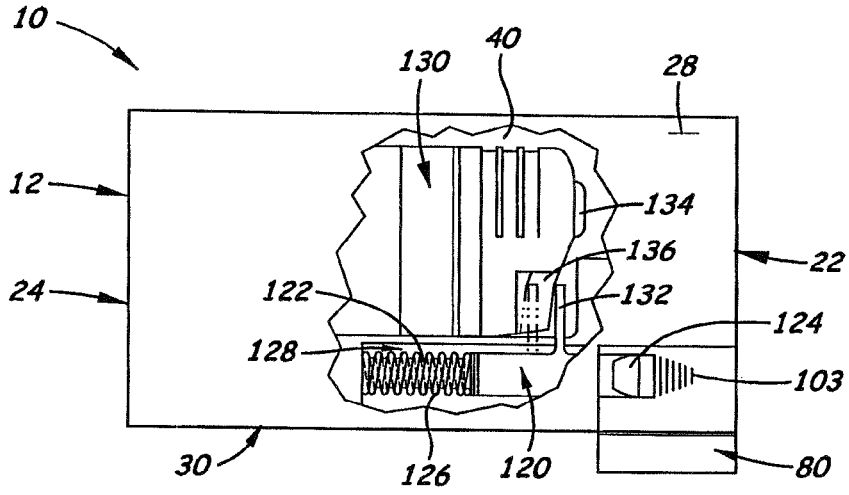
FIG. 4 is a right side elevation view of the invention.
Figure 5:
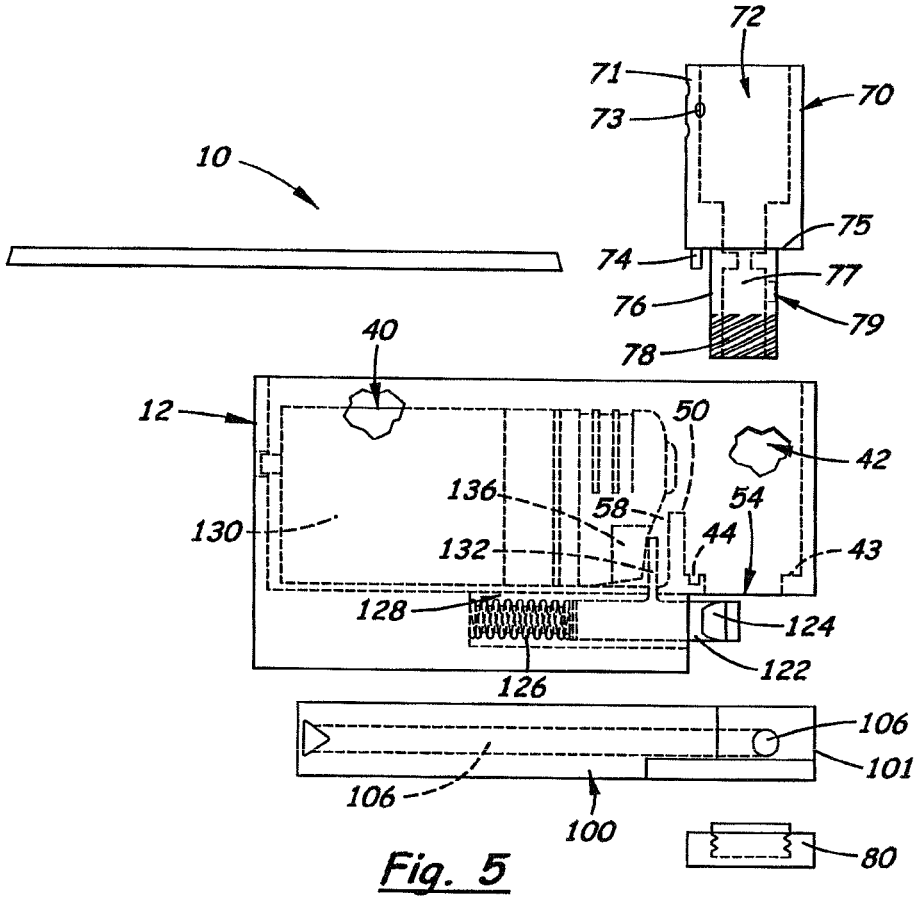
FIG. 5 is an exploded, sectional, side elevation view of the invention.
Figure 6:
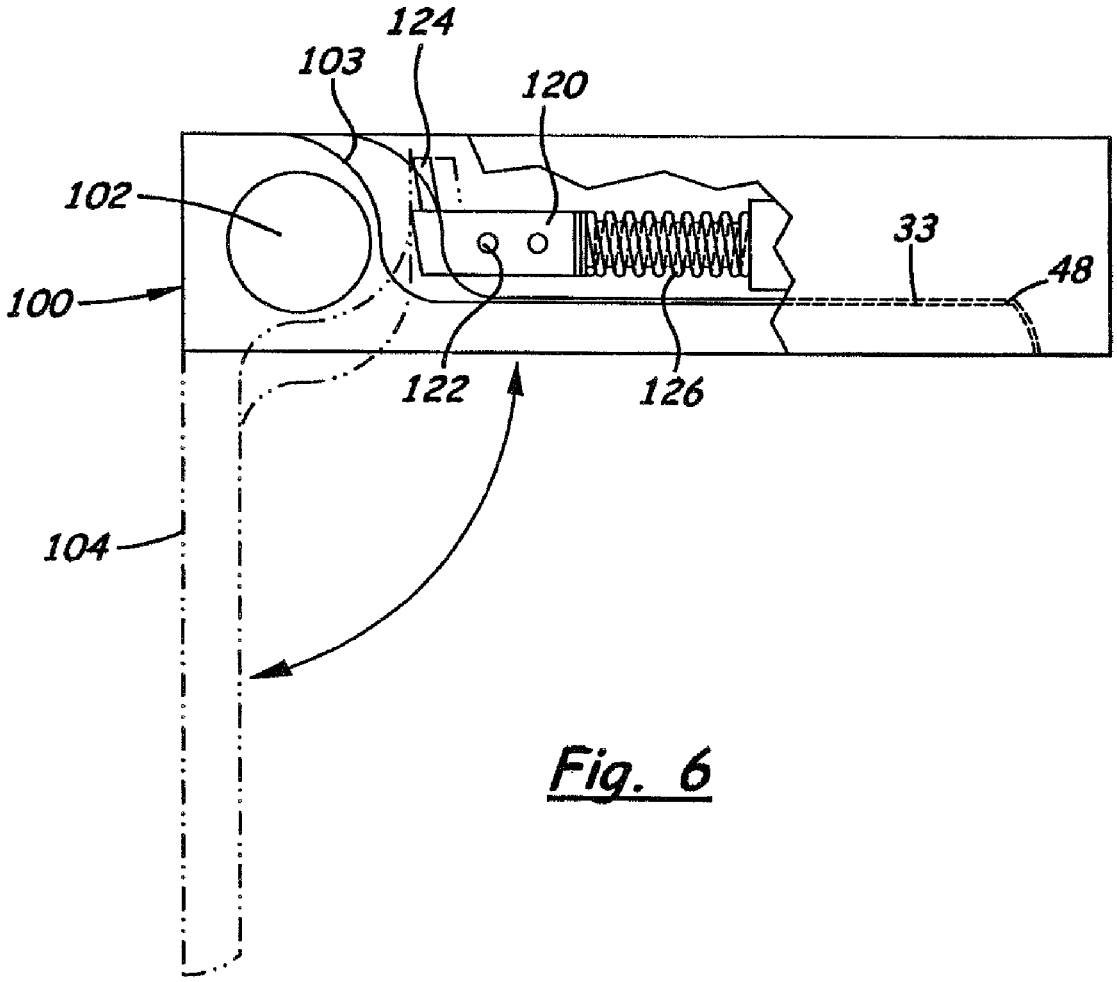
FIG. 6 is a sectional, top plan end view of the invention showing the movement of the mouthpiece.

Shown in the accompanying FIGS. 1-6 is the first embodiment of an auto-igniting smoking pipe, indicated by the reference number 10 with a built-in lighter 130 longitudinally aligned inside a lighter cavity 40 formed inside an elongated body 12. When the pipe 10 is used for smoking, the lighter 130 is automatically activated to continuously produces a flame against the upper bowl 71 formed on the bowl assembly 70 located inside a bowl cavity 42 and filled with a smoking substance 150. When smoking is discontinued, the lighter 130 is automatically de-activated thereby terminating the flame and discontinuing combustion.

The lighter cavity 40 is located behind a vertically aligned bowl cavity 42 also formed on the front section of the elongated body 12. Formed between the lighter cavity 40 and the bowl cavity 42 is a short wall partition 50 (see FIG. 2). In the preferred embodiment, the bowl cavity 42 is a cylindrical bore with a co-axially aligned hole 54 formed therein. Formed on the inside surface the wall partition 50 is an optional vertical slot 58 designed to receive a vertical peg 132 attached to a longitudinally aligned plunger arm 122. The plunger arm 122 is located inside a longitudinally aligned plunger bore 128 formed below the lighter cavity 40. Formed on the bottom surface 30 of the elongated body 12 is an L-shaped recessed area 48 in which the complimentary-shaped, elongated mouthpiece 100 resides.

The elongated body 12 is a polygon with a parallel front and rear rectangular surfaces 22, 24, respectively, and two parallel right and left rectangular surfaces 26, 28, respectively. Formed on the elongated body 12 is a top opening 32. The elongated body 12 includes a flat bottom surface 30 perpendicularly aligned with the front and rear surfaces 22, 24.

As mentioned above, attached to the elongated body 12 and extending over the top opening 32 of the lighter cavity 40, and the bowl cavity 42 is a removable lid 35. In the preferred embodiment, the lid 35 slides between two guide rails 27, 29 formed on the upper edges of the opposite side surfaces 26, 28, respectively. Formed on the front section of the lid 35 is an air hole 36. Formed on the right surface 26 of the elongated body 20 adjacent to the bowl cavity 42 is a side air opening 31. When smoking, outside air 200 travels through the air opening 31 and air hole 36 to support combustion inside the upper bowl 71.

Disposed inside the bowl cavity 42 is a bowl assembly 70. The bowl assembly 70 includes the cylindrical-shaped, upper bowl 71 as mentioned above, and a narrow cylindrical-shaped lower neck 76. Formed between the upper bowl 71 is a cylindrical-shaped cavity 72 that communicates with a longitudinally aligned air passageway 77 formed inside the neck section 76. Formed on the rear surface of the upper bowl 71 is a plurality of holes 73 through which a frame from the lighter's burner 134 may extend to ignite the smoking substance 150 placed inside the cavity 72. Formed on the front surface of the neck 76 is a bore 79 which communicates with the air passageway 77. During use, the bore 79 is aligned with an air passageway 106 formed on the mouthpiece 100 when the mouthpiece 100 is rotated to a perpendicularly aligned position with respect to the elongated body 12. Formed near the distal end of the neck 76 are external threads 79. During assembly, a nut 80 is attached to the external threads 78 to loosely connect the mouthpiece 100 to the neck section 76 on the bowl assembly 70. Also, formed on the shoulder 75 between the upper bowl 71 and the neck section 76 is a downward extending peg 74 that fits into a complimentary-shaped hole 44 formed on a resting surface 43 located inside the bowl cavity 42. When assembled, the peg 74 is inserted into the hole 44 and used to lock the bowl assembly 70 into a fixed position inside the bowl cavity 42.

The mouthpiece 100 includes a wide head 101 and an elongated arm component 104. Formed inside the wide head 101 is a bore 102 perpendicularly aligned. Formed on the upper, inside section of the wide head 101 is a cam surface 103. The cam surface 103 is offset from the bore's center axis thereby enabling the cam surface 103 to selectively press against the plunger arm 122 longitudinally aligned inside a plunger bore 128 formed along the bottom surface of the elongated body 12.

Formed inside the mouthpiece 100 is a longitudinally aligned air passageway 106 that communicates with a bore 102 formed on the wide head 101 when assembled. The distal end of the neck section 76 extends through the bore 102 when the bowl assembly 70 is placed into the bowl cavity 42 and the mouthpiece 100 is placed inside the mouthpiece recessed cavity 48. When the nut 80 is attached to the threads 79, the mouthpiece 100 is able to rotate freely from a longitudinally aligned position to a perpendicularly aligned position over the distal end of the neck 76.

The plunder arm 122 is part of a plunger assembly 120 used to automatically activate the lighter and ignite the smoking substance when the mouthpiece 100 is moved to a perpendicularly aligned position on the elongated body. Formed on the distal end of the arm 122 is a contact head 124. Disposed around the plunger arm 122 is a spring 126 that forces the plunger arm 122 in an outward position from the plunger bore 128.

The cam surface 103 and the contact head 124 on the plunger arm 122 act as an automatic lighting feature that couples the movement of the mouthpiece 100 to the activation switch 132 on the lighter 130 so that the lighter 130 automatically ignites when the mouthpiece 100 is moved to a perpendicularly aligned position. The contact head 124 is pressed into a recessed surface formed on a lower wall formed on the bottom surface 30 of the elongated body 20. During operation, the contact head 124 presses against the cam surface 103 on the mouthpiece 100. When the mouthpiece 100 is rotated, the plunger arm 122 presses the vertical peg attached to the plunger arm 122 against the activation switch 136 on the lighter 130 when the plunger arm122 is forced inward by the mouthpiece 100.

The lighter 130 is designed so that when the activation switch 136 is pressed, a flame is automatically produced that extends into the holes 73 formed on the rear surface of the upper bowl 71. When the mouthpiece 100 is rotated to a longitudinally aligned position, the arm plunger 122 is forced outward by the spring 126, which automatically de-activates the switch 136 and discontinues the flame.

During use, the lid 35 is removed or slid to an opened position on the elongated body 12 so that the smoking substance 150 may be easily packed into the upper bowl 71 by the user. The lid 35 is re-attached or moved to a closed position. The mouthpiece 100 is then rotated to a perpendicularly aligned position with respect to the elongated body 12 thereby activating the lighter 130. The flame from the lighter 130 extends into the upper bowl 71 to burn the smoking substance 150. Outside air 200 enters the upper bowl 71 through holes 31, 36 and travels down the neck 76 through the mouthpiece 100 and into the user's mouth.

Figure 7:
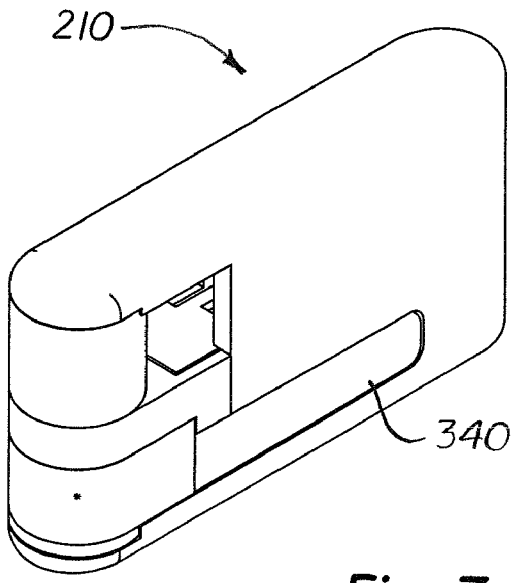
FIG. 7 is a perspective view of the second embodiment of the smoking pipe shown with the mouthpiece in a closed position.
Figure 8:
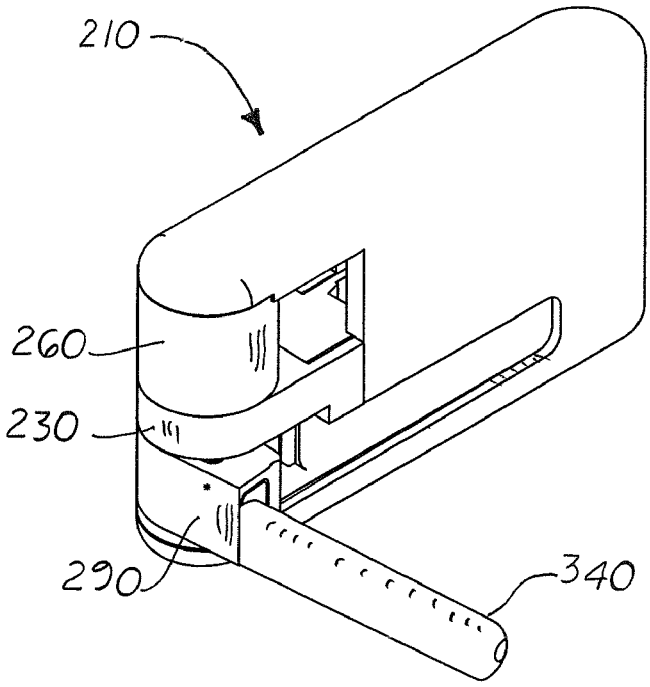
FIG. 8 is a perspective view of the second embodiment of the smoking pipe shown in FIG. 7 with the mouthpiece in an opened position.
Figure 9:
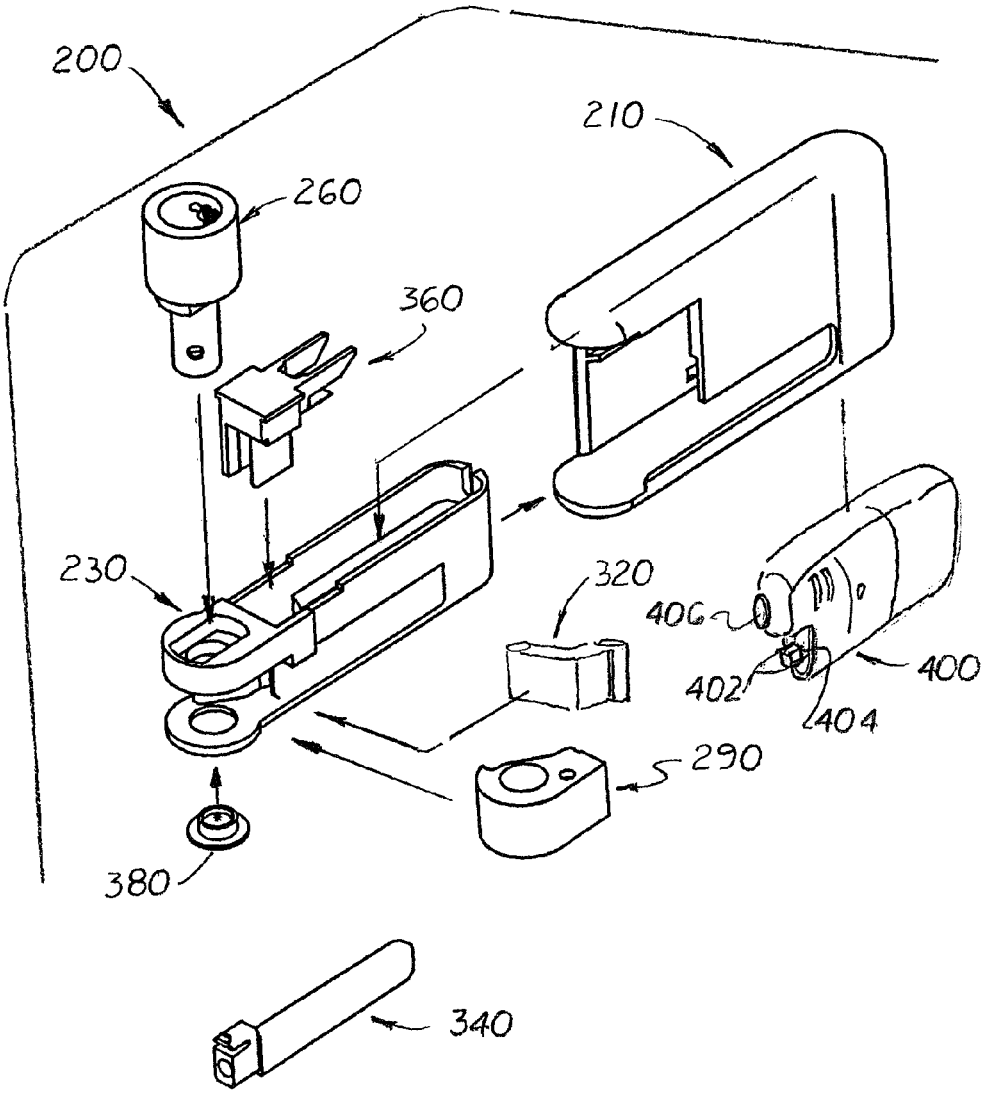
FIG. 9 is an exploded perspective view of the second embodiment of the smoking pipe.
Figure 10:
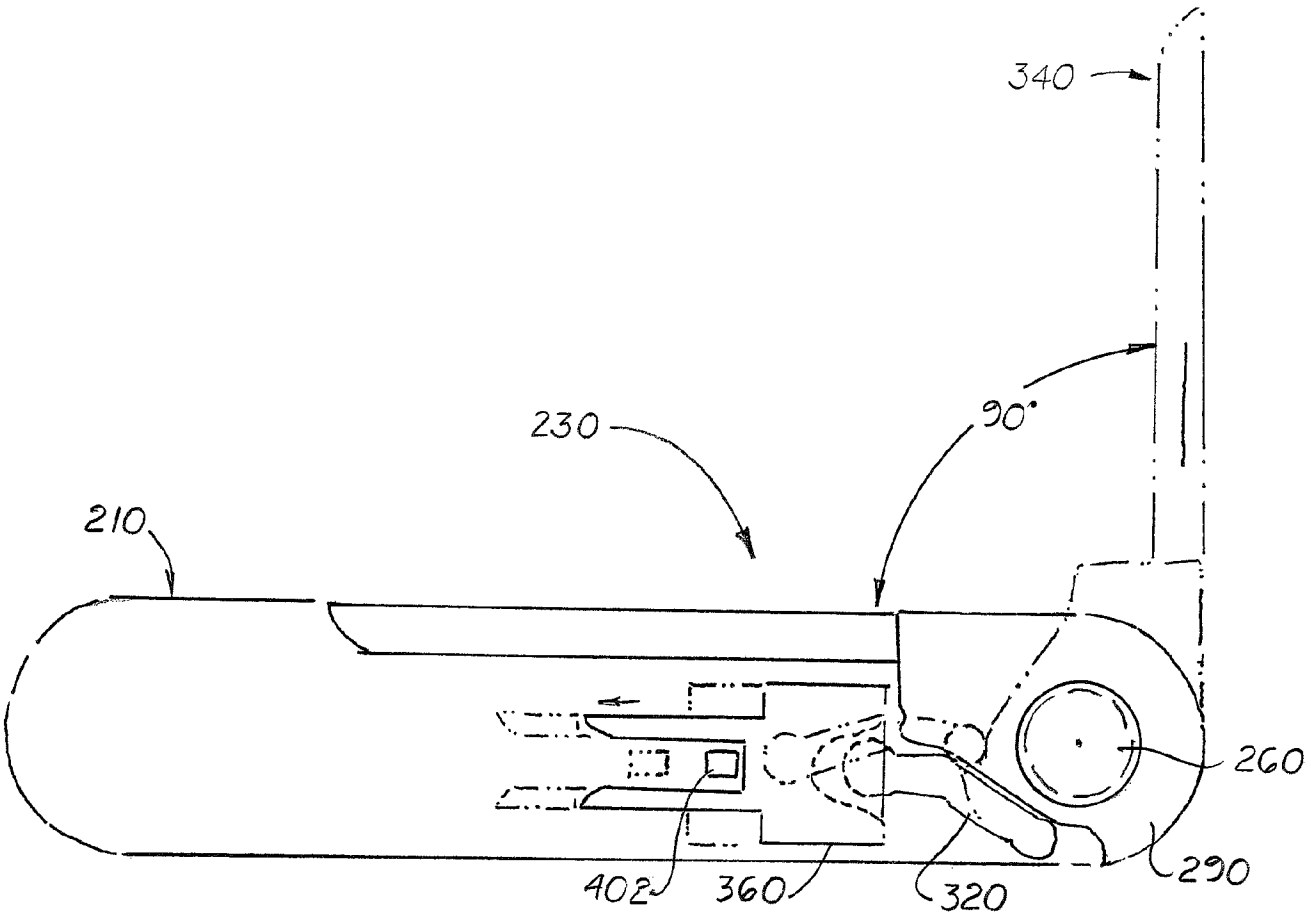
FIG. 10 is a partial top plan view showing the movement of the mouthpiece and the corresponding movement of the ratchet, the cam, the head and the lighter's activation switch.
Figure 11:
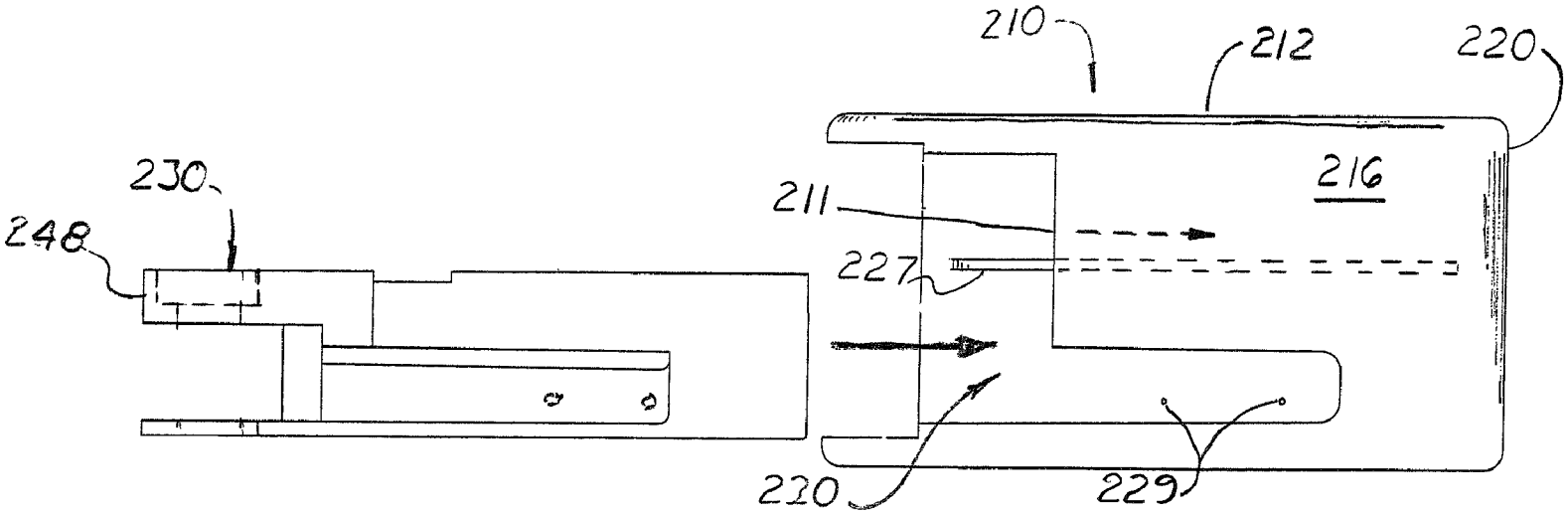
FIG. 11 is a side elevational view of the elongated body used with the second embodiment and the chassis.
Figure 13:
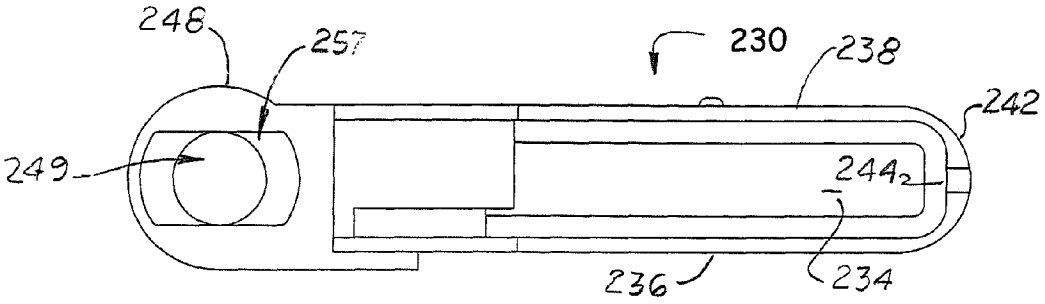
FIG. 13 is a top plan view of the chassis.
Figure 15:
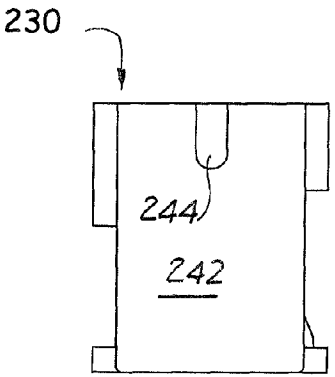
FIG. 15 is a rear end elevational view of the chassis.
Figure 14:
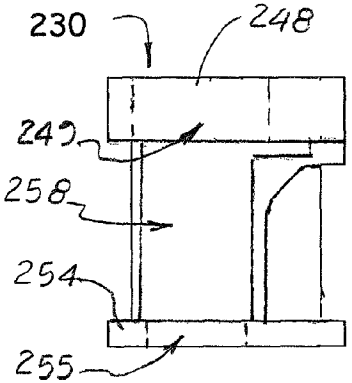
FIG. 14 is a front-end elevational view of the chassis.
Figure 12:
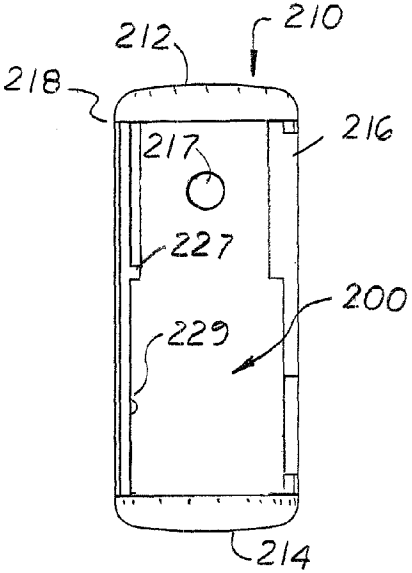
FIG. 12 is a front end elevational view of the elongated body shown in FIG. 11.
Figure 16:
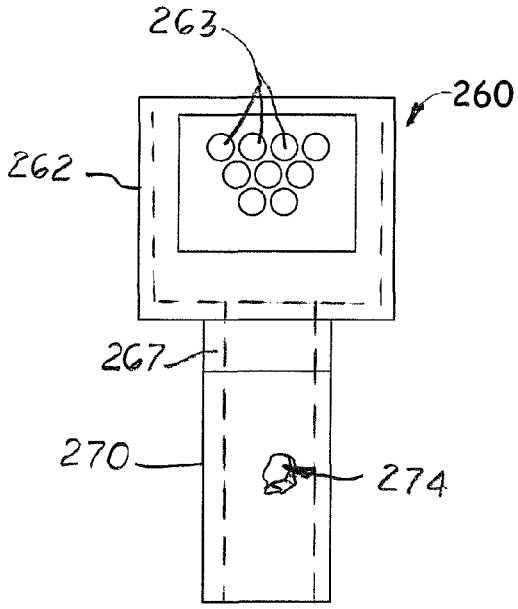
FIG. 16 is a rear elevational view of the bowl assembly
Figure 17:
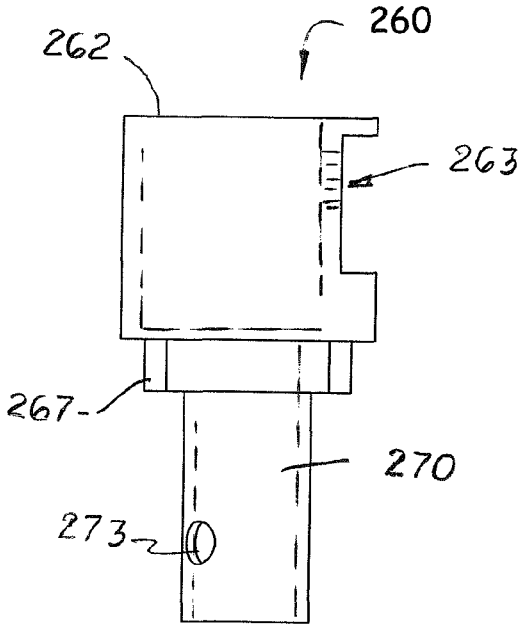
FIG. 17 is a side elevational view of the bowl assembly.
Figure 18:
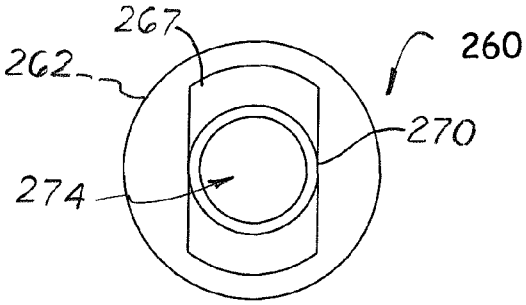
FIG. 18 is a bottom plan view of the bowl assembly.
Figure 19:
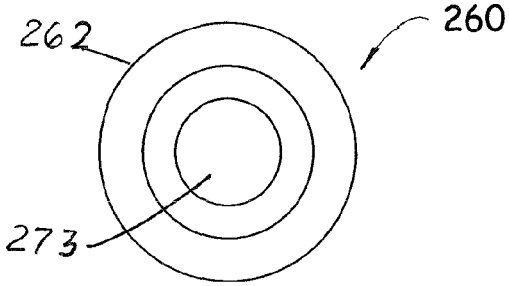
FIG. 19 is a top plan view of the bowl assembly.
Figure 20:
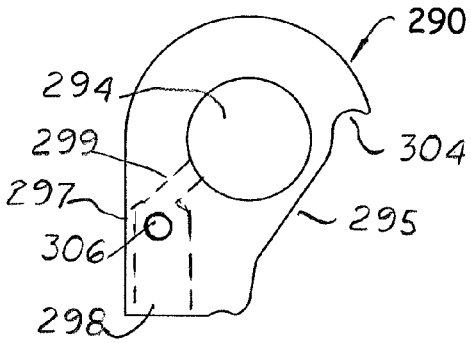
FIG. 20 is a top plan view of the ratchet.
Figure 21:
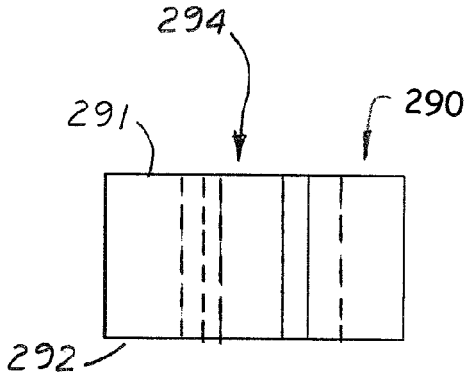
FIG. 21 is a left side elevational view of the ratchet.
Figure 22:
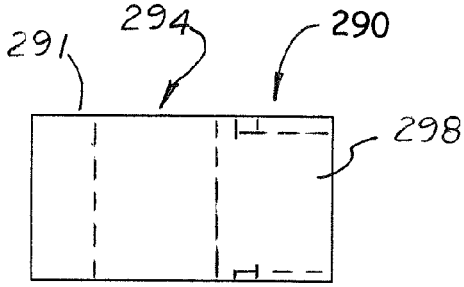
FIG. 22 is a right side elevational view of the ratchet.
Figure 23:
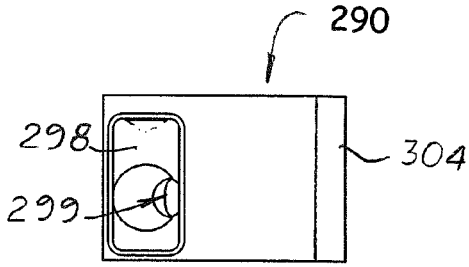
FIG. 23 is a rear plan view of the ratchet
Figure 24:
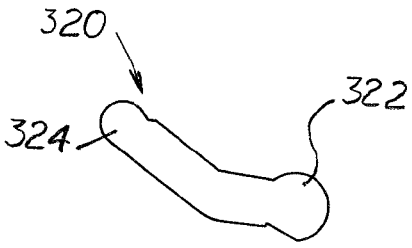
FIG. 24 is a top plan view of the pawl.
Figure 25:
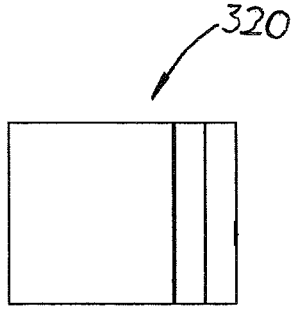
FIG. 25 is a left side elevational view of the pawl.
Figure 26:
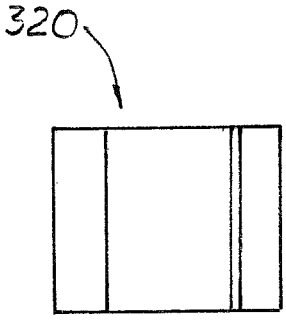
FIG. 26 is a right side elevational view of the pawl.
Figure 27:
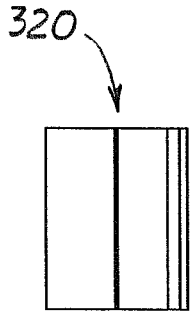
FIG. 27 is a rear elevational view of the pawl.
Figure 28:
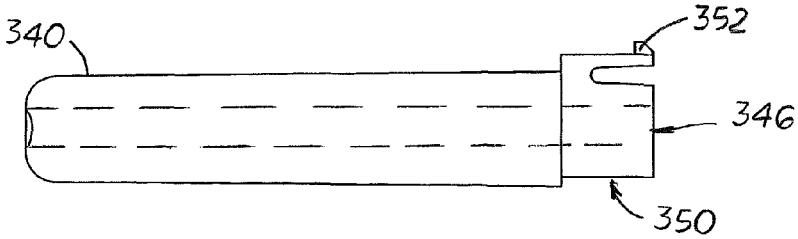
FIG. 28 is a right side elevational view of the mouthpiece.
Figure 29:
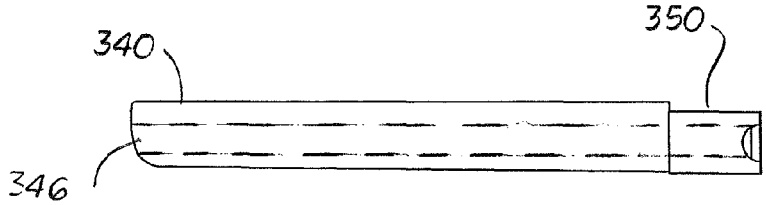
FIG. 29 is a top plan view of the mouthpiece.
Figure 30:
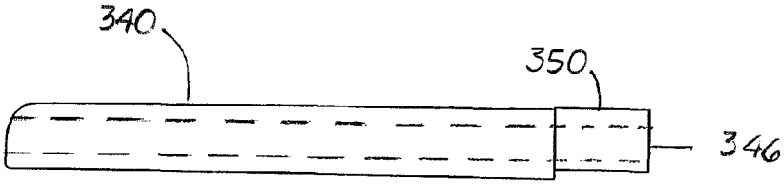
FIG. 30 is a bottom plan view of the mouthpiece
Figure 31:
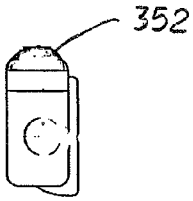
FIG. 31 is a front elevational view of the mouthpiece
Figure 32:
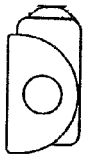
FIG. 32 is a rear elevational view of the mouthpiece.
Figure 33:
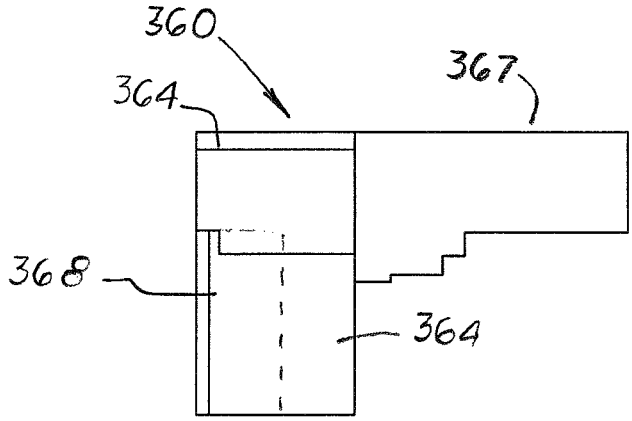
FIG. 33 is a side elevational view of the head.
Figure 34:
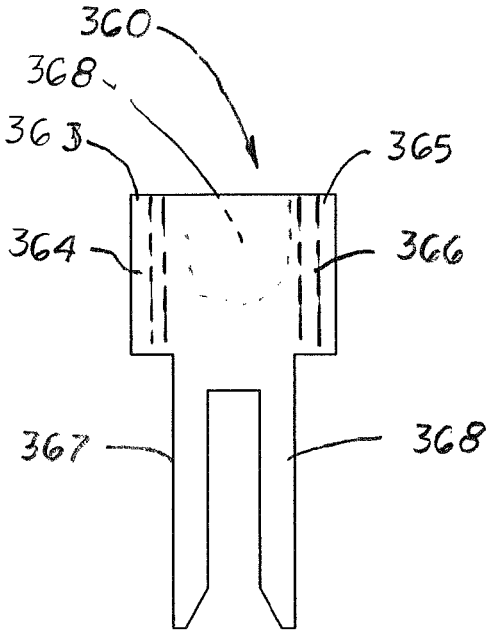
FIG. 34 is a top plan view of the head.
Figure 35:
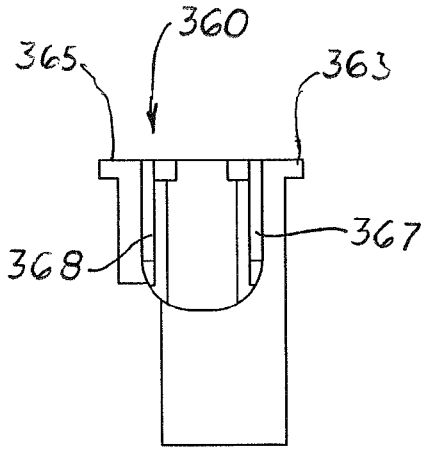
FIG. 35 is a rear elevational view of the head.

Also shown herein is a second embodiment of the auto-igniting smoking pipe, indicated by the reference number 200 which is shown in a assembled configuration in FIGS. 7 and 8, and in an exploded configuration in FIG. 9. The smoke pipe 200 is designed to be used with gas lighters 400 that include an activation switch 402 that automatically resets after being activated. In order to re-activate the switch 402, the switch must be fully pressed from its original location. In the second embodiment, the amount of rotation the mouthpiece 340 required to activate the activation switch 404 is reduced thereby making the pipe 200 easier to use. Once the mouthpiece 340 is moved to its smoking position, and the lighter needs to re-ignited, the mouthpiece 340 only needs to be partially closed and moved back to the open position re-activate the activation switch 404. This feature enables the pipe to be used to vaporize or to combust material inside the bowl assembly.

In the second embodiment 200, a partially enclosed, hollow elongated body 210 is provided with a top surface 212, a bottom surface 214, two opposite side walls 216, 218, an end wall 220 and a front opening 222. Formed on the inside the elongated body 210 is a cavity 211. Form on one side wall (side wall 216 shown) is a mouthpiece slot 224 and a side vent opening 226. Formed inside surfaces of the two side walls 216, 218 are two horizontal abutment edges 227 and at least one detent depressions 229, (two shown). As discuss further below, the two abutment edges 227 help kept the chassis 230 and the head 360 aligned inside the elongated body 210.

Sliding inside the cavity 211 of the elongated body is a rigid chassis 230. The chassis 230 includes an upper cavity 232 designed to house the lower portion of the lighter 400 and the head 360. Formed inside the upper cavity 230 is a horizontal platform 234 used to support the lighter 400 and the head 60. The chassis' two side walls 236, 238 are parallel with a mouthpiece storage cavity 240 formed on one side wall that is aligned and registered with the mouthpiece slot 224 formed on the elongated body 210. The chassis' end wall 242 is closed and includes an optional flame adjustment bore 244 that is aligned and registered with the lighter's adjustment screw when the lighter 400 is positioned on the chassis and the chassis 230 is place inside the elongated body 210.

Formed on the front section of the chassis 230 includes a upper horizontal deck 248 and a lower horizontal deck 254 separated by a ratchet storage space 258. Formed on the upper and lower decks 248, 254 are two aligned and registered bores 249, and 255, respectively. Formed on the top surface of the upper deck 248 is recessed keyway 257 complimentary in shape with a key surface formed on the lower surface of the upper bowl.

During assembly, the gas lighter 400 with an activation switch 402 and flame opening 406 located on one end is inserted in to the upper cavity 232 and on the support platform. The lighter 400 is aligned on the upper cavity 232 so that its activation switch 402 and the flame opening 404 face forward. The lighter's flame opening 406 is located above the activation switch 404. The position of the platform on the chassis 230 is sufficient so that when the lighter 400 is positioned on the chassis 230, the lighter's flame opening 406 is located adjacent to the upper bowl 262 that extends upward from the upper deck 248.

The bowl assembly 260 also includes a narrow lower neck 270 longitudinally aligned and located below the wider upper bowl 262. Extending between the upper bowl 262 and the lower neck 270 is a fully extending smoke and ash passageway 274. Formed on the upper bowl 262 are plurality of air openings 263 which allow heated hot gas created by the lighter's flame to enter the upper bowl 262 to vaporize or burn vegetation material placed in the upper bowl 262. As mentioned above, formed between the lower surface of the upper bowl 262 is a downward extending key 267 that engages a recessed, complimentary shaped keyway 268 formed on the upper deck 248 of the chassis 230. During operation, the key 267 and keyway 268 rotatably lock the bowl assembly 260 in a fixed position on the chassis 230.

Formed on the lower section of the lower neck 270 is a smoke outlet port 273 radially aligned approximately 150 degrees away from the center axis of the air openings 263 formed on the upper bowl 262. Attached to the bottom opening of the smoke and ash passageway 274 on the end of the lower neck 260 is an ash cap 380 that can be easily removed so that ash or unburn material can be removed from the bowl assembly 260.

Mounted on the chassis 230 is a rotating ratchet 290. The ratchet 290 is a irregular shaped structure with a flat top surface 291 and a bottom flat surface 292 and sufficient in thickness to fit within the ratchet space formed between the upper and lower decks 248, 254. Formed on the ratchet 290 is a center bore 294 through with the lower neck 270 on the bowl assembly 260 extends when mounted on the chassis 230. The thickness of the ratchet 290 is sufficient to that it may rotate freely around the bowl assembly's lower neck 270. Formed on one lateral surface of ratchet 290 is a cam surface 295. Formed on the opposite side of the ratchet 290 is a laterally aligned mouthpiece neck 297 with a smoke receiving bore 298 formed therein. A smoke conduit 299 is formed between the center bore 294 and the smoke receiving bore 298. During assembly, an elongated the mouthpiece 340 is inserted into the smoke receiving bore 298. The mouthpiece 340 includes a wide distal end with a flexible tongue member formed thereon that includes an upward extending tab that snap fits into a hole formed on the ratchet 290 to lock the mouthpiece 340 in place on the ratchet 290.

The ratchet's cam surface 292 includes a hook 304 that is pressed against an angled pawl 320. The proximal end 322 of the pawl 320 sits in a receiving cavity 368 formed a moveable head 360 that selectively presses against the activation switch on the lighter 400. When the ratched 290 is rotated in a clockwise rotation, the hook 304 on the cam surface 292 presses against the distal end 324 of the pawl 320 which forces the pawl towards the head 360. The locations of the smoke conduit 296 and the hook 304, the length of the pawl 320 are sufficient so that when the mouthpiece 30 is rotated approximately 90 degrees, the activation switch 404 is activated.

The head 360 includes a main body 362 with two downward extending, parallel legs 364, 366. Formed between the two legs 364 and 366 is a receiving cavity 368. Extending rearward from the main body362 are two parallel wings 367, 368 designed to slide into the two spaces 404 formed on the lighter 400 on opposite sides of the activation switch 404. The two wings 367, 368 help to keep the head 360 longitudinally aligned over the end of the lighter 400. Formed on the top edge of the main body 362 are two lateral abutted tabs 363, 365 that enable the head 360 to be mounted on two side slots formed on the chassis 230 so that the top surface of the head 360 is flush with the top edge of the chassis 230.

During assembly, the bowl assembly 260, the ratchet 290, the pawl 320, the mouthpiece 340, the head 360, and the ash cap 380 are interconnected and mounted on a chassis 230. The chassis 230 is then aligned with the front opening on the elongated body 210 and forced into the elongated body 210. As the chassis 230 is pressed into the elongated body 210, the top edges of the chassis 230 and the head 360 are positioned under the two abutment edges. The two abutment edges hold the head 360 inside the chassis 230 as the pawl forces the head against the activation switch 404. Formed on the side of the chassis 230 is at least one protecting tab 239 that engages one of the detents formed on the inside surface of the elongated body 210 to prevent the chassis 230 from inadvertently sliding out of the elongated body 210.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A smoking pipe, comprising:

a. an elongated body with a top surface, a bottom surface, two opposite side walls, an end wall and a front opening, formed on one said side wall is a mouthpiece slot and a side vent opening;

b. a rigid chassis located inside said elongated body, said chassis includes an upper cavity with a lighter support platform located therein, said chassis includes two parallel side walls with a mouthpiece storage cavity formed on at least one side wall that is aligned and registered with the mouthpiece slot formed on said elongated body, said chassis also includes a forward extending upper deck and a forward extending lower deck separated by a ratchet storage space, said upper and lower decks each includes a bore that are aligned and registered, formed on said upper deck is a recessed keyway;

c. a bowl assembly mounted on said chassis, said bowl assembly includes a upper bowl and a lower neck, formed inside the bowl assembly is a longitudinally aligned smoke and ash passageway, formed on said upper bowl is a plurality of air openings, formed on said lower neck is a laterally extending smoke bore, formed on said bowel assembly is a complimentary shaped keyway that enables said bowl assembly to be rotatably locked in a fixed position on said chassis;

d. a rotating ratchet mounted on said lower neck of said bowl assembly and located in the ratchet space between said upper deck and said lower deck, said ratchet 290 includes a center bore 292 through with the lower neck 270 on the bowl assembly 260 extends, said ratchet includes a cam surface 292 formed on one side and a laterally aligned mouthpiece receiving bore 294 formed on the opposite side, said ratchet includes a smoke conduit formed between the center bore and the smoke bore;

e. a moveable head mounted inside said chassis, said head includes a includes a main body 362 with two downward extending, parallel legs with a pawl receiving cavity formed between them, said head includes two rear extending wings with a flat plunger abutment surface located between them, said wings extend into the spaces formed on the opposite sides of the activation switch on a lighter when placed inside said cavity, f. a pawl disposed between said cam surface on said ratchet and said pawl receiving space on said head, said pawl being sufficient size and shape and said cam surface of said ratchet being located so that when said mouthpiece is rotated between 30 to 90 degrees from the longitudinal axis of said elongated body, said activation switch on said lighter is activated.

2. The smoking pipe as recited in claim 1, further including two horizontal abutment edges and two detent depressions formed on the inside surfaces of said elongated body.

3. The smoking pipe as recited in claim 1 wherein said chassis includes a closed end wall with a flame adjustment bore that is aligned and registered with the lighter's adjustment screw when the lighter is placed inside the chassis.

* * * * *